US005913783A

United States Patent [19]

Weener et al.

[11] Patent Number: 5,913,783

[45] Date of Patent: Jun. 22, 1999

[54] PORTABLE MULTIPLE-PURPOSE FLOOR-CEILING COLUMN FOR OFFICE

[75] Inventors: Robert C. Weener; Barry Lee Andersen, both of Holland, Mich.

[73] Assignee: Haworth, Inc., Holland, Mich.

[21] Appl. No.: 08/981,328

[22] PCT Filed: Jun. 5, 1997

[86] PCT No.: PCT/US97/10569

§ 371 Date: Dec. 31, 1997

§ 102(e) Date: Dec. 31, 1997

[87] PCT Pub. No.: WO97/46776

PCT Pub. Date: Dec. 11, 1997

Related U.S. Application Data

[60] Provisional application No. 60/019,419, Jun. 7, 1996.

[51] Int. Cl.[6] ..... E04G 1/22; E04G 25/04

[52] U.S. Cl. ..... 52/127.2; 52/127.11; 52/239; 52/651.1; 52/749.1; 248/354.1

[58] Field of Search ..... 52/126.6, 127.2, 52/127.11, 239, 749.1, 365, 114, 651.1; 248/354.1, 354.3, 602, 188.8

[56] References Cited

U.S. PATENT DOCUMENTS

| | | |
|---|---|---|
| 1,516,672 | 11/1924 | Franz et al. . |
| 2,974,931 | 3/1961 | Reel et al. . |
| 3,703,269 | 11/1972 | Meriz . |
| 3,734,441 | 5/1973 | Luz . |
| 4,928,916 | 5/1990 | Molloy . |
| 5,033,526 | 7/1991 | DeLong et al. . |
| 5,056,285 | 10/1991 | Frascaroli et al. . |
| 5,155,955 | 10/1992 | Ball et al. . |
| 5,317,855 | 6/1994 | De Leeuw . |
| 5,595,410 | 1/1997 | Wilson et al. . |

FOREIGN PATENT DOCUMENTS

| | | |
|---|---|---|
| 0 245 704 | 11/1987 | European Pat. Off. . |
| 0 522 230 | 1/1993 | European Pat. Off. . |
| 1 377 926 | 9/1964 | France . |

*Primary Examiner*—Carl D. Friedman
*Assistant Examiner*—Winnie S. Yip
*Attorney, Agent, or Firm*—Flynn, Thiel, Boutell & Tanis, P.C.

[57] ABSTRACT

An extendible and contractible support pole assembly for clamping engagement with and extension between a floor and a fixed ceiling. The upper portion of the pole assembly has a releasable clamping structure which is disposed above a drop ceiling and permits the pole assembly to be extended into clamping engagement with the fixed ceiling. The post assembly is provided with structural flanges extending longitudinally therealong to enable other components such as clamps or brackets to be attached thereto so as to permit other office accessories to be mounted in association therewith.

8 Claims, 5 Drawing Sheets

PORTABLE MULTIPLE-PURPOSE FLOOR-CEILING COLUMN FOR OFFICE

This application is a National stage application of International application Ser. No. PCT/US97/10569 under 35 U.S.C. §371 filed Jun. 5, 1997, which International Application is a continuation of U.S. Provisional Application Ser. No. 60/019,419 filed Jun. 7, 1996.

FIELD OF THE INVENTION

This invention relates to an extendible and contractible column or pole arrangement specifically for use in office environments and the like, which column can be telescopically extended to permit secure clamping engagement between a floor and a ceiling, with the column permitting numerous other related accessories or functions to be disposed for cooperation therewith.

BACKGROUND OF THE INVENTION

Many office environments utilize drop ceilings, and small power poles or columns often project downwardly from the drop ceiling to permit power or telecommunication cables to be fed downwardly therealong into work areas disposed adjacent the floor. However, these power poles or columns typically have the upper ends disposed for cooperation with the drop ceiling, and thus the power pole itself has little structural integrity or strength, and the work stations or areas are typically defined by other structural elements such as panels and the like.

With the more recent trend toward the utilization of more open work stations and working regions, and less reliance on panels, there is a need to be able to provide structural support for various components which are used in the working area, including various types of panels and other upright furniture components. There is also a need to permit, under some circumstances, the downward feeding of cables from the ceiling.

This invention relates to an extendible and contractible support pole or column which is intended to be readily positionable and relocatable so as to be clampingly engaged with and extend vertically between the floor and a ceiling, with the upper portion of the pole assembly having a releasable clamping structure which is normally disposed above the drop ceiling and permits the pole assembly to be readily extended and disposed in snug clamping engagement at upper and lower ends thereof with the respective fixed ceiling and floor. The column assembly is provided with structural flanges extending longitudinally therealong to permit other components such as clamps or brackets to be attached thereto so as to permit other office accessories to be mounted in association therewith.

Other objects and purposes of the invention will be apparent to persons familiar with structures of this type upon reading the following specification and inspecting the accompanying drawings.

Figure 1:
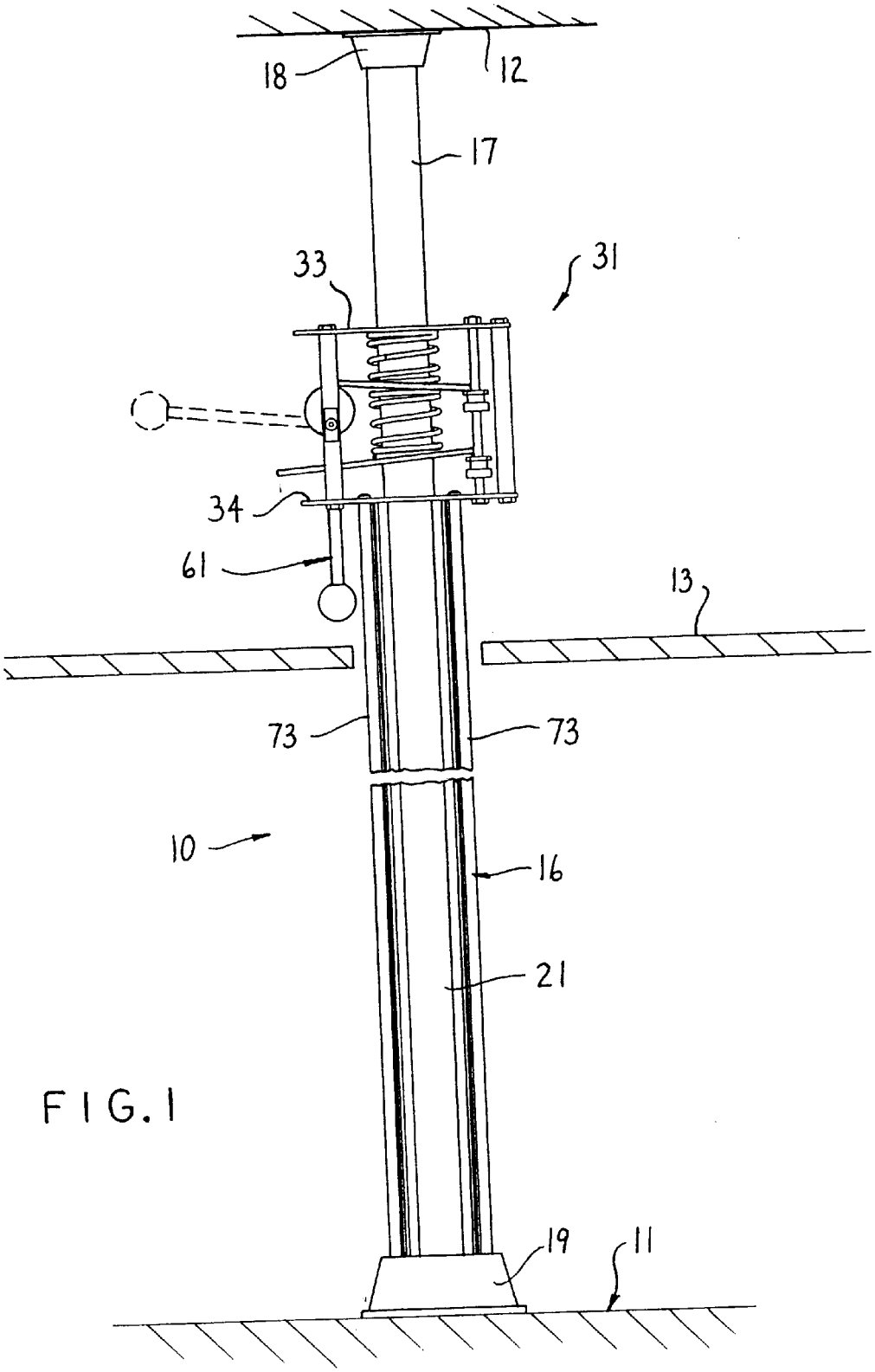
FIG. 1 is a fragmentary side elevational view illustrating the extendible pole assembly of this invention extending between and clampingly engaged with a floor and a fixed ceiling.
Figure 2:
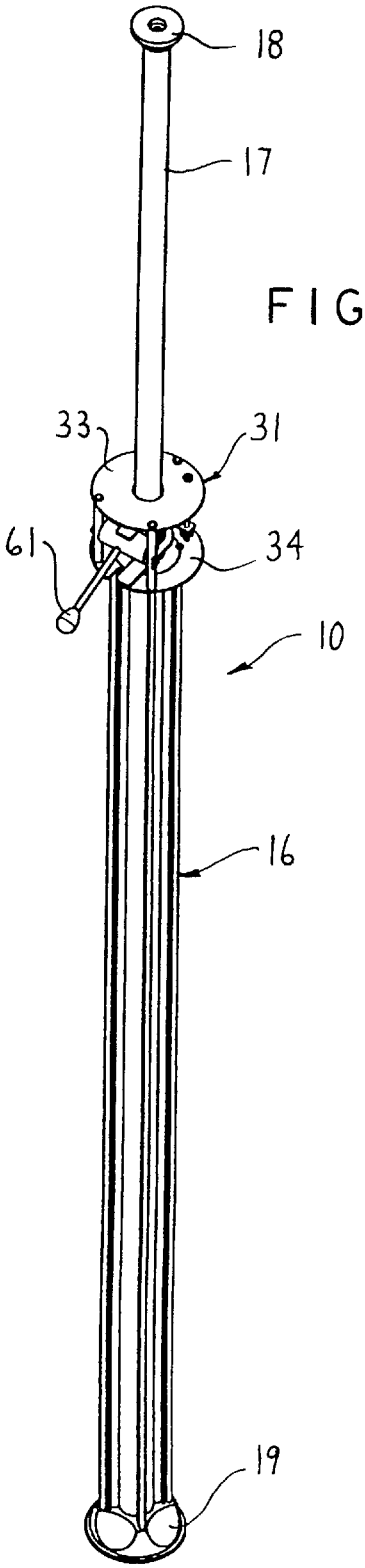
FIG. 2 is a perspective view of the pole assembly of FIG. 1.

Certain terminology will be used in the following description for convenience in reference only, and will not be limiting. For example, the words "upwardly", "downwardly", "rightwardly" and "leftwardly" will refer to directions in the drawings to which reference is made. The words "upper" and "upwardly" will refer to a direction toward the ceiling, and the word "down" or "downwardly" will refer to a direction toward the floor. The words "inwardly" and "outwardly" will refer to directions toward and away from, respectively, the geometric center of the assembly and designated parts thereof. Said terminology will include the words specifically mentioned, derivatives thereof, and words of similar import.

DETAILED DESCRIPTION

Referring to the drawings and specifically FIG. 1, there is illustrated a telescopically extendible and contractible column or pole assembly 10 according to the present invention. This pole assembly 10 is adapted to extend vertically between and be clampingly engaged with a floor 11 and a fixed ceiling 12. It should be noted that the ceiling 12 is intended to represent the rigid or fixed ceiling associated with a building, and that typically there will be provided a conventional drop or false ceiling 13 which will be supported in downwardly spaced relation from the fixed ceiling 12.

The column or pole assembly 10 includes a main vertically-elongate upright support pole or column 16 which is preferably of suitable height so as to project upwardly above the elevation of the drop ceiling 13. This main or base support pole 16 in turn has a top or upper pole 17 slidably telescoped therein and projecting upwardly therefrom. The top pole 17 typically has a cap 18 secured to the upper end thereof and disposed for abutting engagement with the fixed ceiling 12. The lower end of the base or main support pole 16 will normally rest on a suitable support plate or foot 19, the latter in turn being disposed in bearing engagement with the floor 11. The foot 19 will normally not be permanently fixed to the floor, but will be provided with pointed carpet grippers on the underside thereof to facilitate secure engagement thereof with a carpeted floor.

Figure 4:
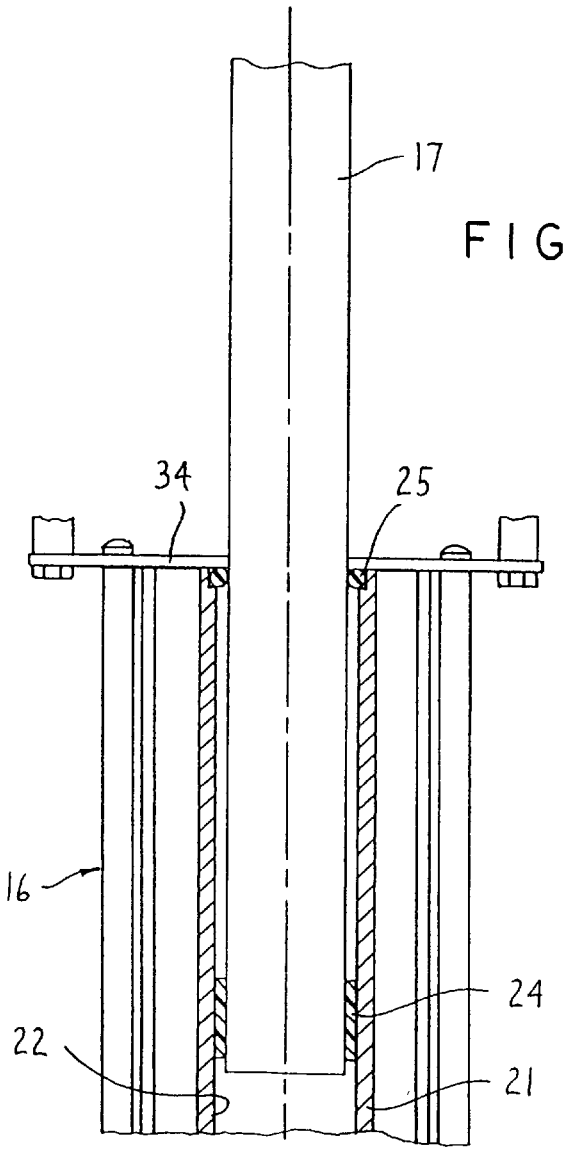
FIG. 4 is an enlarged, fragmentary sectional view illustrating the telescopic relationship between the upper and lower pole members.

As illustrated by FIG. 4, the main or base support pole 16 includes a generally hollow and vertically elongate cylindrical tube 21 provided with a cylindrical opening 22 therein, which tube 21 defines the longitudinal vertical axis 23 of the column assembly. The upper pole 17 is disposed to slidably project downwardly into the cylindrical tube 21 from the open upper end thereof, and the upper pole 17 adjacent the lower end thereof is preferably provided with a sleeve bushing 24 thereon so as to facilitate its slidable guiding along the interior of the cylindrical tube 21. In addition, an elastomeric element such as an O-ring 25 is seated on the cylindrical tube 21 at the upper end thereof, which O-ring surrounds and effects a resilient frictional gripping with the outside wall of the upper pole 17 to assist in normally stationarily holding the pole 17 in a selected position, absent application of significant axially directed force thereto.

The column assembly 10 also has a clamping or locking device 31 associated therewith to enable the column to be extended into engagement with the floor and fixed ceiling, and then fixedly locked in the extended position so that the upper and lower ends of the column remain securely engaged with the ceiling and floor. For this purpose, the clamping or locking device 31 includes a housing structure 32 which is fixed to the upper free end of the base support pole 16, which thus results in the locking device 31 being disposed above the drop ceiling 13. This housing structure includes top and bottom plates 33 and 34, respectively, which are rigidly joined in vertically spaced relation by a plurality of tie rods 35. The bottom plate 34 in turn sits on and is fixed to the upper end of the base upright 16 by fasteners such as screws 36. These plates 33 and 34 have coaxially aligned openings 37 extending centrally therethrough for accommodating the vertical displacement of the upper pole 17.

Figure 3:
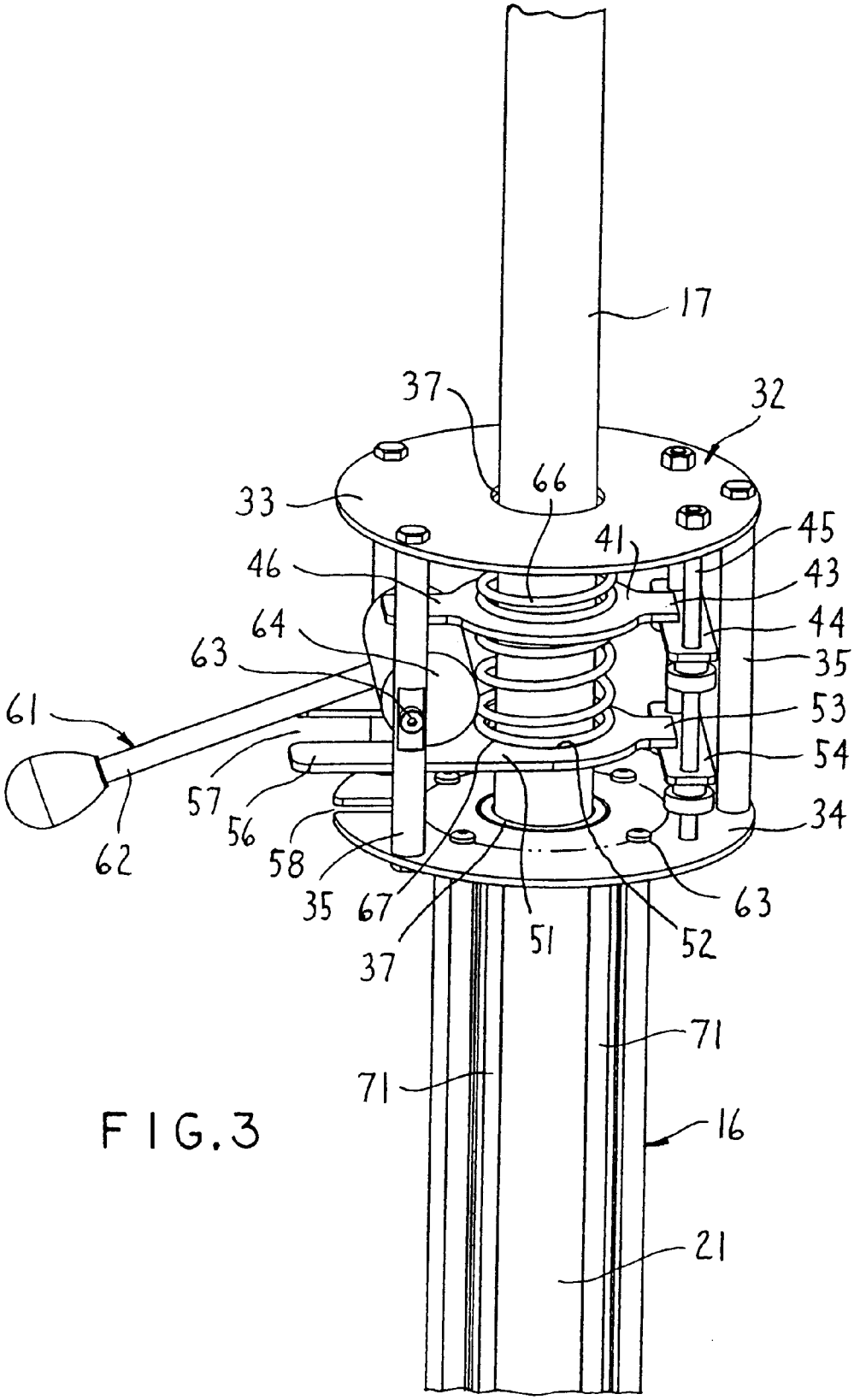
FIG. 3 is an enlarged, fragmentary perspective view illustrating the clamping structure associated with the pole assembly.

As illustrated by FIGS. 1 and 3, the locking device 31 includes an upper locking plate 41 having a central opening 42 therethrough for accommodating therein and permitting passage therethrough of the upper pole 17. The opening 42 is sized so that the diametrically opposite edges thereof will engage the periphery of the upper pole 17 when the locking plate 41 is upwardly angled as illustrated in FIG. 1, thereby lockingly engaging the upper pole 17 and preventing lowering thereof. The locking plate 41 has a radially outwardly projecting tab 43 on one side thereof which projects outwardly for supportive engagement on a support plate 44, the latter extending between and being stationarily supported on a pair of height-adjustable nuts which are provided on tie bolts 45. Upper locking plate 41 has a further radially projecting tab 46 which is positioned so as to project outwardly from substantially the diametrically opposite side of the locking plate from the tab 43.

The locking device 31 includes a lower locking plate 51 which is constructed similar to the upper locking plate 41 in that it includes a central opening 52 through which the upper pole 17 extends. This opening 51 is again sized to permit the pole 17 to move vertically when the plate 51 is disposed substantially horizontally. However, when the plate 51 is angled downwardly as illustrated by FIG. 1, then the diametrically opposite sides of the opening grippingly engage the pole 17 and prevent downward movement thereof. The lower locking plate 51 has radially extending tabs 53 and 56 defined generally on diametrically opposite sides thereof, with the tab 53 projecting outwardly for engagement with a further support 54, the latter also being adjustably positioned on a pair of nuts which are adjustably positionably engaged with the tie bolts 45. The other tab 56 projects diametrically outwardly from the opposite side of the housing through a greater extent so as to be readily manually grippable when desired. This latter elongate tab 56 is of a bifurcated or fork-like construction in that it has a slot 57 formed therein, which slot opens radially inwardly from the free end of the tab.

Locking device 31 is provided with a manually-controlled actuator 61 for controlling the position of the upper locking plate 41. This actuator includes an elongate lever 62 which projects outwardly from the side of the housing and terminates in a knob. This lever 62 at its inner end is pivotally supported on the housing structure by pivot bolts 63 which effectively define a horizontal hinge axis for the lever. The inner end of the lever 62 also has a projecting arm part formed generally as an enlarged cam 64, the latter being eccentrically positioned relative to the hinge axis 63. This cam 64 engages the underside of the tab 46 associated with the upper lock plate 41 and hence maintains this upper locking plate in an inclined locking position when the locking lever is in the actuated position illustrated by solid lines in FIG. 1. In this latter position, the actuating lever 61 projects generally vertically downwardly and is accommodated within the slot 57 formed in the tab 56, and also projects through a similar aligned slot 58 formed in the lower housing plate 34. The generally cylindrical exterior configuration defined by the cam 64, and its engagement with the underside of the tab 46, is such as to positively retain the locking plate 41 in the inclined locking position, and release is possible only by manually swinging the lever 62 upwardly into a release position substantially as indicated by dotted lines in FIG. 1. When in this latter release position, the cam is moved downwardly out of engagement with the tab 46, and a spring 66, which cooperates between the upper locking plate 41 and the top housing plate 33, urges the locking plate to pivot downwardly into a substantially horizontal orientation wherein the tab still engages the cam. In this latter position, the upper pole 17 can be readily moved downwardly into the main pole 16, such as by gripping the upper pole 17 and manually pushing it downwardly into the main pole 16. The lower locking plate 51 will permit this downward contraction of the upper pole upon being moved upwardly by lifting of the elongate tab 56 so that locking plate 51 is in a generally horizontal position.

Conversely, when extension of the pole 17 is desired, then the elongate tab 56 of the lower locking plate 51 is engaged and lifted upwardly so that the locking plate 51 moves upwardly against the urging of a spring 67, until the locking plate 51 is generally in the horizontal position. The pole 17 can then be manually gripped and readily displaced upwardly until the upper end thereof is positioned closely adjacent or only a small distance from the fixed ceiling 12. The lower locking plate 51 is then released and the spring 67 returns it to its downwardly inclined locking position, thereby preventing lowering or retraction of the upper pole 17. The locking lever 62 can then be alternately swingably moved between the released and locking positions illustrated respectively by dotted and solid lines in FIG. 1. During this swinging or pumping movement of the lever 62, each time the lever is moved downwardly into its clamping position the cam 64 engages and tilts the upper locking plate 41 upwardly, causing it to grip the pole 17. During part of this upward displacement of the locking plate 41, it will also engage and cause the pole 17 to be moved upwardly a small extent. Thus, by several alternate pivoting displacements of the lever 62, there is thus provided a movement similar to a one-way ratchet-like drive which affects upward displacement of the pole 17 until it contacts the fixed ceiling 12, and thereafter further ratcheting of the lever 62 causes sufficient force reaction axially along the telescopic pole assembly as to ensure that the upper and lower ends thereof are securely respectively clamped against the fixed ceiling 12 and the floor 11.

Figure 5:
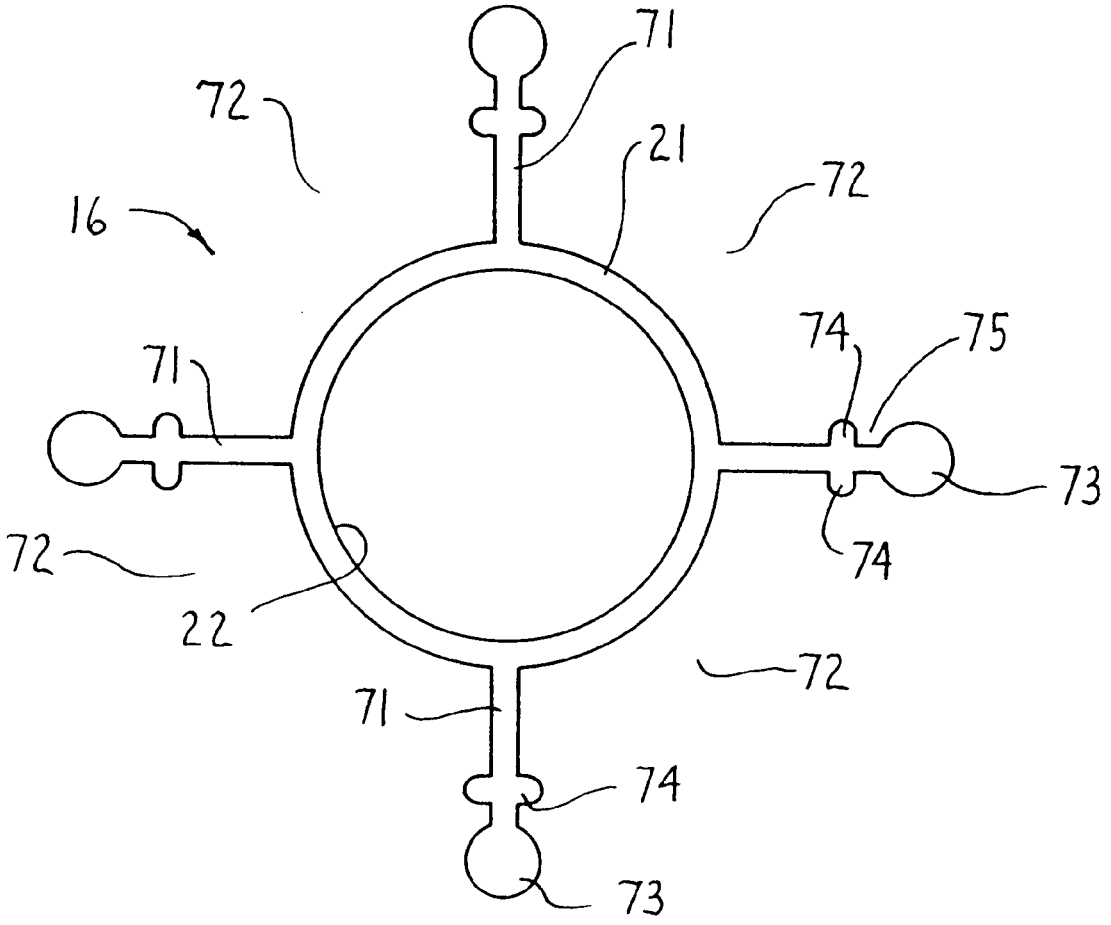
FIG. 5 is a top plan view of the bottom upright or pole.
Figure 6:
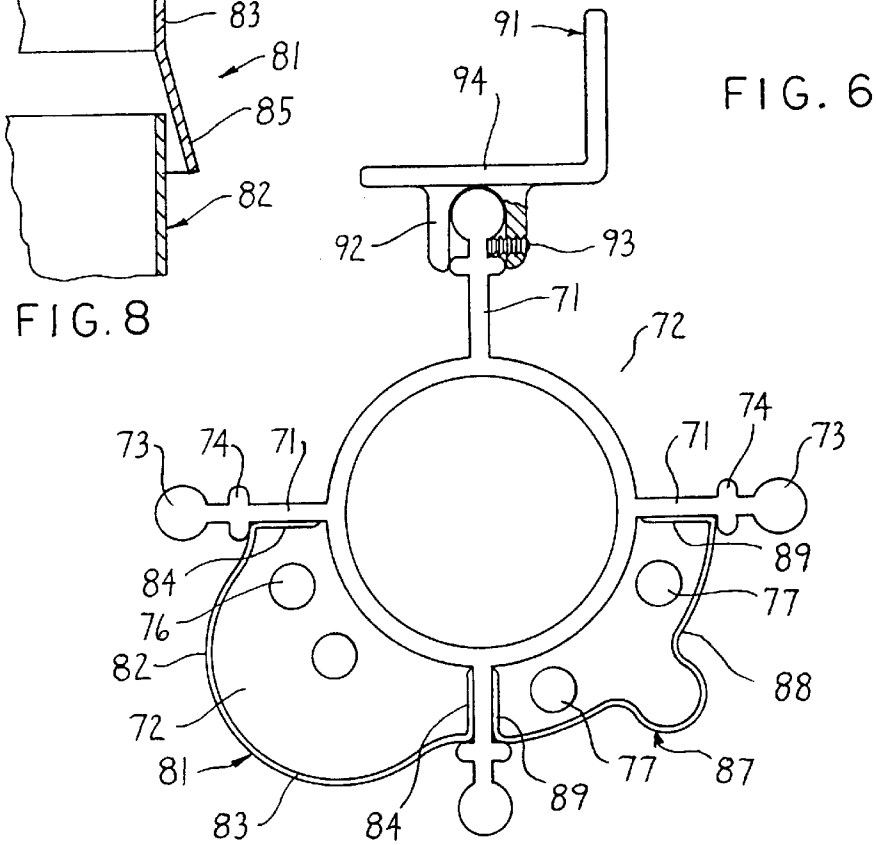
FIG. 6 is a plan view of the bottom upright and illustrating the mounting of various clips or covers thereon.

The base pole 16, as illustrated by FIGS. 5 and 6, is also provided with structural features which enable the pole to provide other structural and functional relationships with respect to cooperation with other components which are useable in an adjacent work area. For this purpose, main upright 16 includes a plurality of ribs or flanges 71 which are integrally fixed to and project radially outwardly from the hollow cylindrical tube 21. There are four such flanges 71 in the illustrated embodiment, such flanges being uniformly spaced at angles of about 90°. These ribs or flanges 71 extend longitudinally in generally parallel relationship along the length of the tube 21, and each circumferentially adjacent pair of ribs defines a vertically extending and radially outwardly opening, channel-like space 72 therebetween. The outer longitudinally-extending edge of each rib 71 is provided with a rodlike part 73 fixed thereon, the latter preferably being of circular cross-section. Rib 71 also has a small transverse rib 74 projecting transversely from opposite sides thereof, this transverse rib 74 being disposed radially inwardly a small distance from the rod part 73 so as to effectively define a sidewardly-directed retaining notch 75 therebetween.

The vertically extending channel-like spaces 72 permit cables, such as indicated at 76 and 77, to be fed vertically downwardly therealong from above the drop ceiling 13 so as to permit the cables to more readily access the workspaces adjacent the column assembly. Further, the channels 72 can be provided with suitable clips or covers engaged therein, either solely for enclosure purposes, such as for enclosing or confining cables, or for other purposes.

Figure 8:
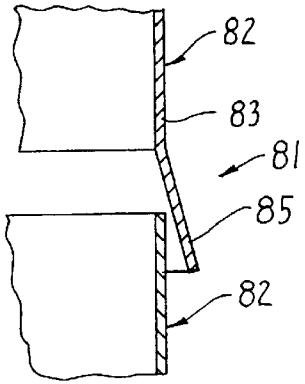
FIG. 8 is a sectional view taken in part along line 8—8 in FIG. 7 and illustrating the manner in which two covers vertically align and partially overlap.
Figure 7:
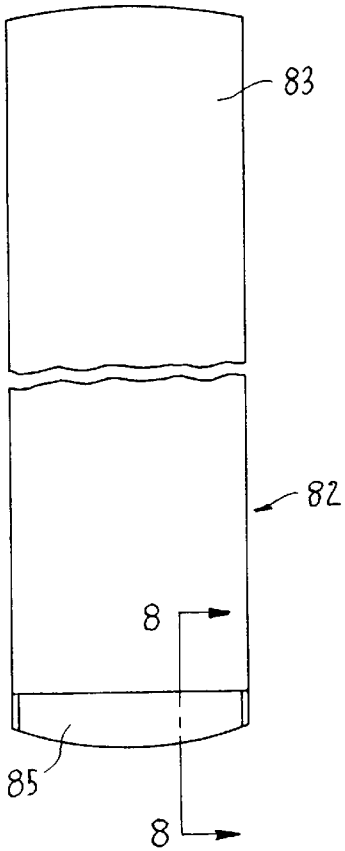
FIG. 7 is a front elevational view of a cover which mounts on the upright pole.

Referring to FIGS. 6–8, there is illustrated a cover structure 81 which can be positioned to extend longitudinally along the column to hence enclose one of the channels 72. The cover structure 81 involves a plurality of generally vertically aligned cover segments 82, each being of a predetermined elongated length and having a generally convexly rounded outer wall 83 which along opposite edges terminates in cantilevered flanges 84, the latter projecting in generally perpendicular relationship to one another. These flanges 84 are adapted to be resiliently snapped into engagement with the circumferentially adjacent ribs 71 by being engaged rearwardly of the transverse ribs 74, as illustrated in FIG. 6.

The cover segments 82 are preferably provided with a tab 85 at the lower end thereof, which tab is slightly outwardly sloped as it projects downwardly. This tab 85 enables two vertically adjacent segments 82, as illustrated in FIG. 8, to be positioned sufficiently closely adjacent such that the tab 85 downwardly telescopes over the upper end of the next lowermost cover segment 82.

Figure 9:
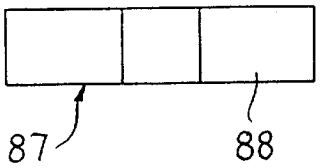
FIG. 9 is a front elevational view of one type of pole-engaging clip.

FIG. 6 also illustrates that the channels 72 can be provided with small retainer clips 87 which include an outer wall 88 which at opposite ends is provided with inwardly cantilevered edge flanges 89, the latter again projecting in substantially perpendicular relationship to one another. The edge flanges 89 again resiliently snap into engagement with the circumferentially adjacent ribs 71 so as to be retained inwardly of the transverse ribs 74. This retainer clip 87 is normally of short axial (i.e., vertical) extent, as illustrated in FIG. 9, and thus one or more such clips 87 can be positioned in spaced relationship vertically along the channel 72 so as to appropriately confine elongate articles such as cables or the like within the channel.

The base column 16 and specifically the provision of the structural ribs 71 associated therewith also permit other types of connecting structures to be joined to the column. For example, as also illustrated in FIG. 6, there is illustrated a bracket 91 which includes a channel-like mounting part 92 which effectively fits over the free end of the rib 71, with suitable securing devices such as set screws 93 being insertable into the notches 75 to fixedly secure the bracket to the main pole. The bracket can have any desired type of mounting structure thereon, same being illustrated with a generally L-shaped bracket plate 94 for securement to some other component, such as an upright space-dividing panel.

Provision of the rodlike part 73 at the free end of each rib 71 also enables this rodlike part to effectively function as a vertical hinge part for permitting a mating bracket-type hinge to be engaged therewith.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. An extendible and contractible, vertically elongate, portable column assembly for fixed clamping engagement vertically between a fixed ceiling and a floor, comprising:

a vertically elongate hollow base column, and a vertically elongate upper column slidably telescoped into and projecting upwardly out of said base column, said base column having means associated with a lower end thereof for engagement with the floor, and said upper column having means mounted on an upper free end thereof for engagement with the fixed ceiling;

holding means cooperating between said base and upper columns for positionally axially fixing said upper column in a selected axially extended position relative to said base column when said column assembly is extended between and clampingly engaged with the fixed ceiling and floor, said holding means including a housing structure which is fixed to the base column adjacent the upper end thereof, an upper tiltable locking plate which surrounds and is releasably engageable with the upper column to effect locking thereof against downward contraction into the base column when in an inclined locking position, and a lower tiltable locking plate which surrounds said upper column and is normally urged into an inclined locking position to prevent downward contraction of said upper column;

ratcheting means for upwardly displacing said upper column into contact with the fixed ceiling, said ratcheting means including a cam mounted on said housing structure for rotation about a generally horizontal axis, said cam being eccentrically positioned relative to the axis and engaged with said upper tiltable locking plate, said ratcheting means further including an elongate actuator arm connected to said cam such that oscillating movement of said actuator arm rotates said cam and moves said upper locking plate between a generally horizontal release position and said inclined locking position to extend said upper column from said base column and generate a compressive force in said column assembly between the fixed ceiling and the floor such that said column assembly is securely clamped therebetween.

2. The column assembly according to claim 1, wherein said lower locking plate includes a bifurcated tab on a first end for allowing passage of said actuator arm therethrough.

3. The column assembly according to claim 1, wherein oscillating of said actuator between an upper position and a lower position results in incremental upward driving of said upper column relative to said base column.

4. The column assembly according to claim 1, wherein said base column has a plurality of structural flangelike walls fixed thereto and projecting radially outwardly therefrom, said flangelike walls extending longitudinally of said base column and being disposed in angularly spaced relationship therearound.

5. The column assembly according to claim 4, wherein said flangelike walls each include transverse ribs extending outwardly from opposite sides thereof.

6. The column assembly according to claim 5, further including a cover structure extending longitudinally along said base column, said cover structure having a generally convexly rounded outer wall and a pair of cantilevered flanges projecting in generally perpendicular relationship to each other, said flanges being resiliently engaged with said ribs, with said cover structure cooperating with said flangelike walls and said base column to form a channel therebetween.

7. An extendible and contractible, vertically elongate, portable column assembly for fixed clamping engagement vertically between a fixed ceiling and a floor, comprising:

a vertically elongate hollow base column, and a vertically elongate upper column slidably telescoped into and projecting upwardly out of said base column, said base column having means associated with a lower end thereof for engagement with the floor, and said upper column having means mounted on an upper free end thereof for engagement with the fixed ceiling;

holding means cooperating between said base and upper columns for positionally axially fixing said upper column in a selected axially extended position relative to said base column when said column assembly is extended between and clampingly engaged with the fixed ceiling and floor, said holding means including a housing structure which is fixed to the base column adjacent the upper end thereof, an upper tiltable locking plate which surrounds and is releasably engageable with the upper column to effect locking thereof against downward contraction into the base column when in an inclined locking position, and a lower tiltable locking plate which surrounds said upper column and is normally urged into an inclined locking position to prevent downward contraction of said upper column;

ratcheting means for upwardly displacing said upper column into contact with the fixed ceiling, said ratcheting means being movably mounted to said housing structure and engageable with said upper tiltable locking plate to generate a compressive force in said column assembly between the fixed ceiling and the floor such that said column assembly is securely clamped therebetween;

said housing structure including:

a bottom plate attached to said base column adjacent said upper end thereof, said bottom plate having a first aperture, said upper column passing through said first aperture;

a top plate having a second aperture, said upper column passing through said second aperture; and a plurality of tie rods rigidly joining said top and bottom plates.

8. The column assembly according to claim 7, wherein said housing structure includes a pair of vertical tie bolts connected between said top and bottom plates, wherein said tie bolts have upper and lower horizontal support plates connected therebetween, said upper tiltable locking plate having a tab resting on said upper support plate, and said lower tiltable locking plate having a tab resting on said lower support plate.

* * * * *